US005156750A

United States Patent [19]

Henricson et al.

[11] Patent Number: 5,156,750

[45] Date of Patent: * Oct. 20, 1992

[54] METHOD AND APPARATUS FOR THICKENING A FIBER SUSPENSION AND REMOVING FINE PARTICLES THEREFROM

[75] Inventors: Kaj Henricson, Kotka; Mika Mäkelä, Huutjärvi; Toivo Niskanen, Hamina; Olavi Pikka, Karhula; Vesa Vikman, Kymi, all of Finland

[73] Assignee: A. Ahlstrom Corporation, Noormarkuu, Finland

[ * ] Notice: The portion of the term of this patent subsequent to Dec. 4, 2007 has been disclaimed.

[21] Appl. No.: 573,334

[22] Filed: Aug. 24, 1990

Related U.S. Application Data

[63] Continuation-in-part of Ser. No. 216,842, Jul. 8, 1988, Pat. No. 4,975,204.

[30] Foreign Application Priority Data

Jul. 8, 1987 [FI] Finland ..... 873020
Nov. 4, 1987 [FI] Finland ..... 874854

[51] Int. Cl.[5] ..... B01D 29/62; B01D 33/46

[52] U.S. Cl. ..... 210/783; 210/791; 210/383; 210/396; 210/411; 210/414; 210/415; 162/56; 162/380

[58] Field of Search ..... 210/748, 780, 785, 791, 210/804, 383, 396, 398, 402, 411, 414, 415, 435, 349; 162/56, 380; 8/156

[56] References Cited

U.S. PATENT DOCUMENTS

| | | | |
|---|---|---|---|
| 1,866,970 | 7/1932 | Garland | 210/411 |
| 2,900,926 | 1/1960 | McKee | 100/117 |
| 3,029,951 | 4/1962 | Cannon | 210/415 |
| 3,174,622 | 3/1965 | Lamort | 210/415 |
| 3,363,759 | 1/1968 | Clarke-Pounder | 210/415 |
| 3,455,821 | 7/1969 | Aremaa | 210/414 |
| 3,581,893 | 6/1971 | Rich | 210/415 |
| 3,586,172 | 6/1971 | Young | 210/415 |
| 3,680,696 | 8/1972 | Morin | 209/240 |
| 3,814,246 | 6/1974 | Wilson et al. | 210/374 |
| 3,849,302 | 11/1974 | Seifert | 210/415 |
| 4,188,286 | 2/1980 | Holz | 210/415 |
| 4,276,159 | 6/1981 | Lehman | 210/415 |
| 4,351,728 | 9/1982 | Egelhof et al. | 210/415 |
| 4,491,501 | 1/1985 | Klein | 162/60 |
| 4,749,474 | 6/1988 | Young | 210/415 |
| 4,855,038 | 8/1989 | Le Blanc | 210/415 |
| 4,932,633 | 10/1933 | Haug | 210/785 |
| 4,954,249 | 9/1990 | Gero et al. | 210/413 |
| 4,975,204 | 12/1990 | Henricon et al. | 210/785 |

FOREIGN PATENT DOCUMENTS

| | | |
|---|---|---|
| 1102604 | 6/1981 | Canada . |
| 41712 | 9/1969 | Finland . |
| 53229 | 11/1977 | Finland . |
| 62872 | 3/1983 | Finland . |
| 68005 | 3/1985 | Finland . |
| 71671 | 10/1986 | Finland . |
| 54-88302 | 7/1979 | Japan . |
| 56-14792 | 4/1981 | Japan . |
| 1118646 | 7/1968 | United Kingdom . |
| 1148039 | 4/1969 | United Kingdom . |
| 1280607 | 7/1972 | United Kingdom . |
| 40366 | 9/1977 | United Kingdom . |
| 2009274 | 6/1979 | United Kingdom . |
| 1557688 | 12/1979 | United Kingdom . |
| 2025249 | 1/1980 | United Kingdom . |

OTHER PUBLICATIONS

Chemical Abstracts, vol. 95, No. 8, Aug. 24, 1981, p. 99, Columbus, Ohio.

Chemical Abstracts, vol. 103, No. 8, Aug. 26, 1985, p. 90, Columbus, Ohio.

*Primary Examiner*—Stanley S. Silverman
*Assistant Examiner*—Christopher Upton
*Attorney, Agent, or Firm*—Cohen, Pontani, Lieberman & Pavane

[57] ABSTRACT

In the inventive method and apparatus for the continuous discharge of water and fine particles from a suspension, particularly fibrous pulp, the pulp or suspension is thickened without forcing the removal of water through a relatively thick, uncontrollably gathered fiber mat. In the method, the suspension to be thickened is fed into a filtering chamber, the suspension is continuously mixed for equalizing consistency differences, the liquid is continuously removed from the suspension through a filter and the thickness of a fiber mat which forms on the filter surface is controlled by subjecting the mat to shear stresses. In a thickening apparatus for practicing this method, at least one of co-operating surfaces—i.e. the filtering surface (8) and its counter-surface (10)—is provided with loosening members (12) for non-mechanically limiting the thickness of a fiber mat forming on the filtering surface and thereby preventing the uncontrolled formation of such a mat on the filtering surface (8).

21 Claims, 6 Drawing Sheets

METHOD AND APPARATUS FOR THICKENING A FIBER SUSPENSION AND REMOVING FINE PARTICLES THEREFROM

CROSS-REFERENCE TO RELATED APPLICATION

This is a continuation-in-part of copending U.S. patent application Ser. No. 216,842, filed Jul. 8, 1988, now U.S. Pat. No. 4,975,204.

FIELD OF THE INVENTION

The present invention relates to a method and apparatus for the continuous discharge of water from a suspension, especially from fibrous pulp, whereby pulp is thickened without the water being filtered through a thick, uncontrollably gathered fiber mat and so that fine particles are removed therefrom.

BACKGROUND OF THE INVENTION

In the pulp and paper industry there are various processes which are carried out with a low consistency of pulp, even under 1%. Such processes include, for example, normal and reverse vortex cleaning. Subsequent to vortex cleaning the pulp is directed to a processing stage, as for example a thickener, or to the head box of a paper or drying machine. In any event, thickening always follows vortex cleaning in the paper making process.

The treatment of fibrous material, especially cellulose and wood fiber material, often takes place, as mentioned above, in low consistency suspension. For example, screening with perforated or slotted screens is carried out with a consistency of 1 to 3%. Subsequent to such screening the fibrous material is, for various reasons, thickened to a higher consistency. Often the consistency is thereby raised to the range of 10 to 15%, by way of example, for storage or bleaching.

Thickening is carried out in accordance with modern techniques by means of different types of disk or drum thickeners and curved filters. In conventional drum and disk thickeners the discharge of liquid, i.e. thickening, is based on so-called "gravity deckers", vacuum filters or pressure filters.

In gravity deckers the thickening is carried out by means of a horizontally mounted drum formed of perforated plate and covered with wire cloth. The pressure difference required for the thickening results from the level difference between pulp in the trough and filtrate in the filtrate chamber. Pulp may be filtered either from the inside of the drum to the outside or from the outside to the inside, which latter direction is the most common. In practice the diameter of the drum may be 4 m of which, for example, 60% is underwater. The maximum pressure difference is thus about 20 kPa. The pressure difference at the bottom dead center is zero, which difference increases to its maximum value toward the surface of the pulp in the trough. As a consequence substantially no thickening takes place on either side close to the bottom dead center. The situation is also similar in that part of the drum which is not underwater. Thus, a considerable part of the drum surfaces of the gravity deckers is inefficiently utilized. The capacity of that part or parts of the drum in efficient use also varies according to the prevailing pressure difference relative to the filtering surface. The specific thickening capacity of gravity deckers varies in accordance with the pulp and the running or operating conditions, but is typically in the range of 400 to 700 $l/m^2/min$. These types of thickeners are typically used to prethicken low consistency pulp as, for example, from 0.5% to 1.5–5%.

The filtering surface of the drum is kept clean or open to the flow by moving the surface against the filtrate or by using air to clean it. For example, a paper mill producing 500 tons of 90% consistency pulp requires a filter with a diameter of 4 m and a length of 7 m, the surface area being about 88 $m^2$ of wire surface, to thicken the pulp from 0.5% to 1.5%.

The thickening method using a curved filter is also based on gravity decker filtering. The suspension to be thickened is pumped onto an inclined filtering surface. The thickening capacity is in practice 3 to 5% and the specific capacity of liquid discharge is about the same as that of drum filters. This arrangement has the advantage of not utilizing any mechanically moving members, but it also has a drawback in that the apparatus is relatively easy to clog because the attainment of efficient cleaning is difficult. Curved filter type thickeners are used in the pulp and paper industry when minor thickening and low pulp capacities are involved.

The above-described conventional pulp thickening apparatus or "thickeners" are characterized in that the thickening is carried out using very small pressure differences in more or less open equipment and only part of the filtering surface is utilized.

The small pressure difference and the only partial use of the filtering surface result in a poor ability to discharge liquid. The open construction and operational principles result in the possible inclusion of air in the pulp and filtrate. Air in the pulp decisively weakens, as is known, the infiltration qualities of the pulp.

In other heretofore known and earlier-used arrangements techniques, different types of vacuum filters are most common. The consistency of pulp in these filters is caused to increase through the removal of water from the pulp through a filter surface such, for example, as through a wire cloth covered by a thick fiber mat. In thickening pulp it is possible, by means of the suction effect on the pulp, to use a maximum pressure difference of about 0.5 bar because a stronger vacuum would, undesirably, cause the filtrate to boil.

The pressure difference required for filtering in vacuum and disk thickeners is achieved by a suction leg. Such thickeners differ from gravity deckers in that a pulp layer is formed therein. Thus, subsequent to thickening the consistency of the pulp is 8 to 14%; the capacity of a vacuum or disk thickener is accordingly about the same as that of a gravity decker. The difference between them is that the pulp web, in a vacuum or disk thickener, is formed by suction on the filtering surface through the pulp suspension when that surface is underwater. The filtrate is removed from the web formed on that part of the drum, when the same has risen above the surface of the suspension, so as to achieve the above-noted discharge consistency of 8 to 14%. It is clear that when forming a fiber mat on the filtering surface, the discharge of liquid through the pulp layer substantially slows due to the appreciable flow resistance of the filter web.

It is not advantageous to use this type of thickener for the purpose of prethickening, although it may be employed when the required discharge consistency is relatively high. The specific thickening capacity varies in accordance with the quality of the pulp and the volumetric flow conditions, e.g. in the range of 50 to 300

$l/m^2/min$. When employing the above-described apparatus two vacuum filters of that size would be necessary if seeking to achieve a thickened consistency of 10%. The advantage of utilizing a disk filter, rather than a vacuum drum filter, is that more filtering surface can be provided in the same device volume.

A pressure filter differs from a vacuum drum filter in that, in the former, the filtering pressure difference is generated by pressure rather than the suction or vacuum effect of the latter.

The problem with these and many other types of prior art thickeners is their tendency to clog. Where, for example, the pressurized suspension to be thickened is fed to a thickener, the pressure difference is in principle unlimited; in laboratory tests of such an arrangement this type of thickener became clogged by sulfate pulp in ten seconds, after which it had to be cleaned.

Several methods are known to prevent such clogging of or to loosen the web from the filter. For example, in the disclosures of Finnish Patent No. 41712 and U.S. Pat. No. 3,455,821 it is intended to clean the filter surface by vibration. However, the damping ability of the gaseous and fibrous paper pulp prevents the vibrations from having the intended cleaning effect.

Another cleaning method is shown in Finnish Patent No. 68005, according to which cleaning of the disk filter is carried out using compressed air. At a certain stage of the disk sector circulation, compressed air is directed to the inside of the disk sector whereby the air blast loosens the filtered pulp from outside of the sector.

The object of the present invention is to avoid or minimize the drawbacks and deficiencies of the above-mentioned prior art solutions and to create a new method and apparatus for the continuous thickening of 0.5 to 20% consistency pulp, without having to remove liquid through a thick fiber mat format uncontrollably on the filter surface due to a pressure difference and, therefore, also to remove fine impurities in the liquid. The filter plates are theoretically able to remove considerably greater amounts of liquid than in practice because the thickened pulp which collects on the surface of the filter plate effectively prevents the discharge of greater amounts of liquid. Thus, it is possible to considerably increase the filtering and separating capacity if the formation of a thick fiber mat on the surface of the filter plate can be controlled.

A method and apparatus for solving this problem by enabling substantially total fluidization of the pulp flow to be thickened is disclosed in Finnish Patent Application No. 781789 (Gullichsen). The apparatus provides a cylindrical conduit having a perforated wall disposed about a centrally-located rotor. The rotating rotor fluidizes the suspension whereby the fibers of the suspension are separated in the suspension and water can be filtered through the filter surface. As the suspension is totally fluidized a fiber mat is unable to form or collect on the filter surface and thereby plug the openings of the filter surface.

However, a tremendous amount of energy is required in the method and apparatus of this Finnish application of Gullichsen needed to fluidize the pulp flowing through the conduit during the time necessary to separate the liquid. The amount of energy needed thus required can be compared as follows to the energy needed when using the apparatus of the present invention. We may for this purpose assume a situation in which pulp of 10% consistency is dewatered to a consistency of 20%. Gullichsen must fluidize all of the suspension within the filtering chamber, whereby the required energy is E20 kW/mass ton and the rotational speed of the rotor is n20 rpm. E20 is the energy necessary to fluidize pulp at a consistency of 20%; n20 is the rotational speed of the rotor necessary to create shear stresses of sufficient magnitude to fluidize pulp at a 20% consistency.

SUMMARY OF THE INVENTION

We have, however, found that is not necessary to fluidize the total mass pulp flow to be able to remove liquid and fine impurities from the suspension as efficiently as in Gullichsen. It need only be insured that a thick fiber mat will not form on the filtering surfaces and that the changes in consistency, measured as a function of distance from the filtering surface, are minimized. Based on these principles, the dewatering of pulp in accordance with the present invention is operationally divided into three basic stages:

1. Mixing of the pulp in the mixing zone;
2. Controlling the thickness of the fiber mat on the filter surface and loosening and removal of the extra fiber material from that surface in the thickening zone; and
3. Removing the liquid through a filtering plate with openings small enough to prevent fibers from passing therethrough but large enough to allow liquid and fine scale particles smaller than said openings to pass through the filter surface.

First, the energy needed for mixing the pulp in the filtering chamber so as to achieve a uniform pulp with respect to inlet consistency is $Em=0.03 \ldots 0.15 * E20$ and the rotational speed of the rotor is $n=0.4 \ldots 0.7 * n20$. Second, the energy used for controlling, loosening and removing the fiber mat from the filter surface is $El=0.5 \ldots 0.8 * E20$. It should also be noted that the energy mentioned above is subjected to the filter surface and not to the whole filter chamber. Finally, the average energy used by the method and apparatus in accordance with the present invention is $E=0.15 \ldots 0.5 * E20$.

In addition, the present invention solves yet another problem. As earlier stated, the consistency of the pulp in the filtering chamber tends to increase toward the filtering surface and the present invention is able to prevent this by continuously mixing the pulp. However, the consistency of the pulp also increases toward the discharge end of the filtering apparatus in situations in which the flow of pulp to be thickened is axial. This phenomenon creates difficulties in controlling the operation of the filtering apparatus; at one end of the apparatus the fiber mat forms on the filtering surface at a certain pressure, while at the other end of the apparatus more pressure could advantageously be employed for removing liquid through the filtering surface.

The purpose or object of the present invention is to create an apparatus in which a continuous flow of pulp to be thickened is introduced onto the filter surface, which pulp does not permanently or uncontrollably attach to or collect on the filter surface but, rather, flows along the surface toward the discharge opening in such a way that no thick unbroken, uncontrolled fiber mat is generated and the pulp thickens in a continuous fashion. This operation may be facilitated by using known filter drums, the diameter of the perforations or the width of the slots of which is even less than 0.3 mm, whereby the pulp fibers do not pass through the perforated plate. Significant to apparatus applying this variation of the inventive method according to the invention is the requirement that the size of the pores, slots or perforations be sufficiently small for this purpose; it has been noted in tests that for most wood fibers a perforation size of 0.2 to 0.3 mm is sufficiently small. When such a small perforation size is used liquid can be removed, and yet the filtrate does not include or contain or carry disturbingly many fibers. In one performed test in which the consistency of the pulp was raised from 10% to 15%, the fiber consistency of the filtrate was less than 0.1%. However, tests have also shown that small particles may pass through and are separated from the fibers with the filtrate. In addition, the fibers found in the filtrate are mostly fines, which means smaller fiber fractions.

A further significant feature of the invention resides in the mixing of pulp in the thickening chamber by a moving member so as to continuously equalize its consistency and so that, even relatively close to the filter surfaces, the pulp consistency does appreciably differ from the average consistency. The operational advantages of the method and apparatus of the present invention, in both increased consistency and the uniformity of the consistency of the thickened pulp, far surpass and outnumber the effects of previously-known methods and apparatus.

In one variation of the method according of the present invention, the suspension to be thickened is introduced into the thickening apparatus in a pressurized state. A substantially thin layer of pulp is brought into communication with the filtering surface, this layer being mixed continuously such that the consistency of the suspension is maintained substantially constant throughout the layer, the fiber mat is prevented from uncontrollably forming on the filtering surface, and the thickness of the fiber mat is controlled by regulating the pressure difference across the filtering surface.

A preferred feature of the method of the invention is that the pulp to be thickened is introduced into the filtering chamber substantially along the full axial length of the chamber. In addition, the suspension is caused to rotate in the chamber, the liquid being removed from the suspension and the suspension being discharged from the filtering chamber along substantially the full length of the chamber whereby the suspension consistency is maintained substantially uniform throughout the filtering chamber.

The apparatus for thickening fiber suspensions in accordance with the present invention includes at least one of the cooperating surfaces—preferably the filtering surface and its counter-surface—being provided with means for non-mechanically limiting the thickness of a fiber mat formed on the filtering surface, thereby preventing uncontrolled formation of a fiber mat on the filtering surface.

In a preferred embodiment of the inventive apparatus, a substantially cylindrical member is disposed within the apparatus interior and includes a substantially axial slot through which the suspension to be thickened flows between the cylindrical member and the filtering surface.

Another preferred embodiment of the inventive apparatus includes an apparatus housing provided with a conduit for gas to be fed into the apparatus for backflushing the openings of the filtering surface and for creating a gas bubble centrally within the apparatus for controlling the total thickness of the pulp layer to be thickened.

The advantages achieved in accordance with the invention include, among others, acceleration of the thickening operation and an increase in the ability to discharge liquid from the thickener, since no thick fiber mat layer—which would prevent liquid from flowing from the center of the pulp stream to the filter surface—is permitted to uncontrollably form from the pulp to be thickened. Additional advantages of the closed arrangement to be herein disclosed are, by way of example, that inconvenient odors are not generated in the thickening process and that the apparatus may be pressurized or subjected to a partial vacuum.

A still further and important advantage over some prior art methods and apparatus is the considerably lower energy consumption of the present invention as compared to prior art devices and processes.

BRIEF DESCRIPTION OF THE DRAWINGS

The invention is described below in detail, by way of example, with reference to the enclosed drawings, in which.

DETAILED DESCRIPTION OF THE PREFERRED EMBODIMENTS

Figure 1:
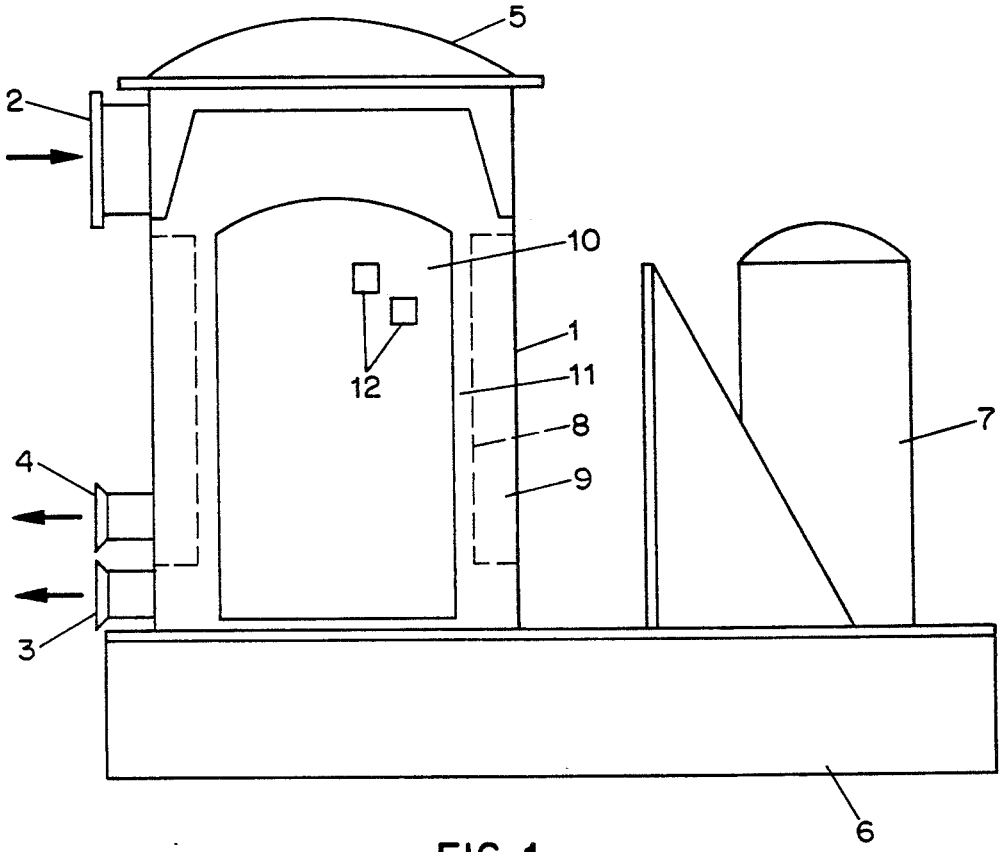
FIG. 1 is a schematic elevational illustration of a first embodiment of an apparatus for carrying out a method in accordance with the present invention.

Illustrated in FIG. 1 is a first embodiment of a pulp thickening apparatus constructed in accordance with the invention. As there shown, the thickening apparatus includes a cylindrical outer casing 1 with an inlet connection 2 for pulp to be thickened, an outlet connection 3 for the thickened pulp and an outlet connection 4 for the filtrate, a top cover 5 and a frame structure 6 including a base plate and a drive means 7. Disposed within the casing 1 is a drum 8 for operation as a filter surface and radially outwardly bounding an annular space 9 for the filtrate. Interiorly of the drum 8 is a rotor 10 arranged for rotation in predeterminately close proximity to the filter surface 8. By so arranging the form of the rotor 10 that it accelerates the pulp to a sufficient circumferential speed, it is possible to thereby carry out suitably efficient mixing of pulp. An alternative is to arrange the thickening drum as a rotor, whereby the purpose of the counter-part—i.e. the stator—is to operatively keep the pulp stationary or, rather, to permit it to flow axially downward between the rotating drum and the stator. On the surface of the rotor 10 are provided members 12 for loosening the fibrous layer. Equipment or devices for discharging light impurities, such as plastics or like, may also be attached to the apparatus.

The pulp to be thickened is introduced into the apparatus through an inlet connection 2 from which the pulp flows onto the rotor 10 and further into the ring-shaped thickening chamber 11 between the rotor and the filtering surface 8. The rotor, and especially its members 12, is effective to rotate the pulp so that a fiber mat is not able to freely form on the filter surface. Due to the rotor rotation the pulp being thickened is continuously mixed so that its consistency is uniformly increased throughout the pulp layer in the filtering chamber. It is clear, however, that the consistency of the pulp in the filtering chamber is increased as it passes or flows downward in the chamber. The liquid being filtered through the openings of the filtering surface is discharged through outlet connection 4 from the filtrate chamber 9 and the thickened pulp is discharged through outlet connection 3 from the lower part of the apparatus.

Figure 2:
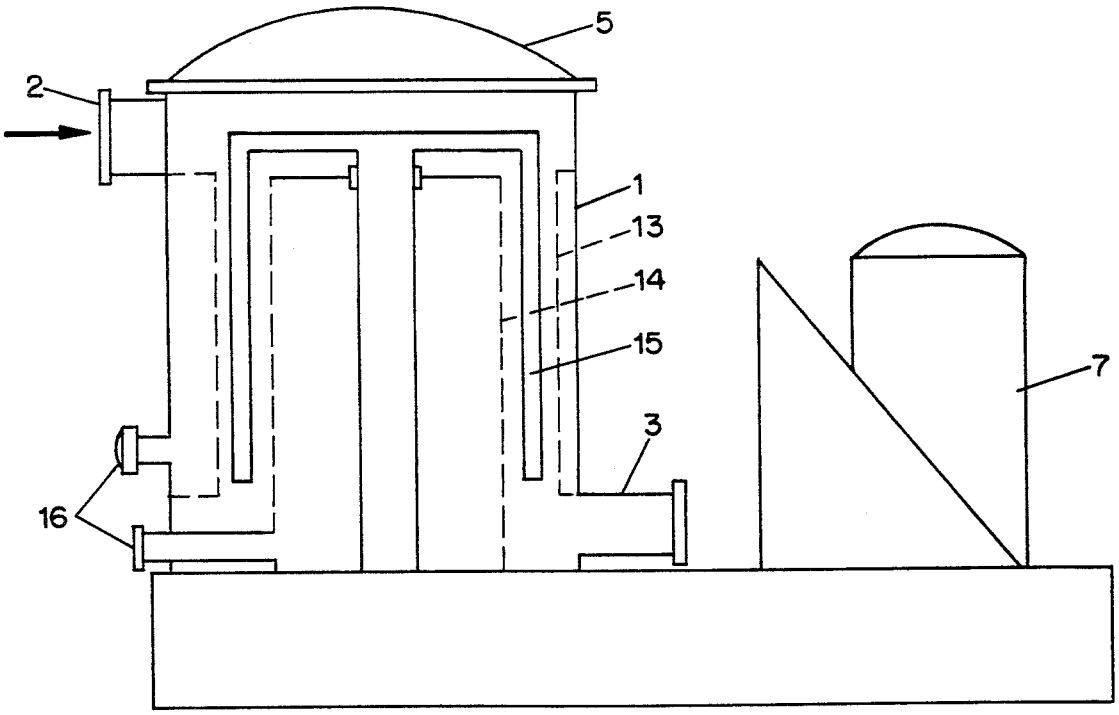
FIG. 2 is a schematic elevational illustration of a second embodiment of an apparatus for carrying out a method in accordance with the present invention.

A second embodiment of the invention is illustrated in FIG. 2 and includes a thickening apparatus formed primarily of substantially the same or like components as the FIG. 1 apparatus hereinabove described. The primary difference between the two is that the apparatus of FIG. 2 is provided with two filter surfaces or drums 13, 14 between which a rotatable rotor 15 is arranged. The operation of the FIG. 2 apparatus is substantially the same as that shown in FIG. 1 with the exception that, in the former, the filtrate is discharged through the two outlet connections 16.

Figure 3:
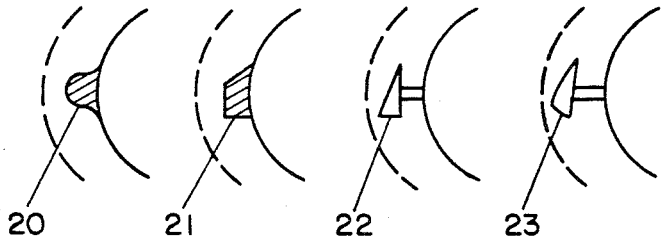
FIG. 3 illustrates four embodiments of recesses provided on the rotor surface.

FIG. 3 illustrates several different types or configurations of members (identified by the reference numeral 12 in FIG. 1) for mixing the suspension and for controlling the thickness of the fiber mat on the filter surface, the filter surface being subjected to reciprocating or alternating pressure or suction pulses which loosen fibers stuck in the filter surface openings or fibers that have partly penetrated the openings, and by virtue of which the flow of filtrate through the filter surface is facilitated. With specific reference to FIG. 3, the pulsating member 20 is formed as a hemispherical protrusion arranged on the surface of the rotor or on the blade of the rotor. A bulge member 21, on the other hand, has a steeply inclined or stepped upstream edge and a relatively gently inclined or ramped or sloped downstream edge. Another alternate member 22 is a variation of the member 21 and comprises a rib that extends close to the surface of the filter plate, the upstream edge being relatively steeply inclined or stepped and the downstream edge being more gently or gradually inclined or sloped along and throughout the length of the rib. Still another member 23 is illustrated as a variation of the member 22 and includes a rib designed to consume as little power as possible—that is, it has a wing-like or aerodynamically-contoured form.

It is also advantageous to group the rotor and the pulsating members in the rotor and design them in such a way that the inflowing pulp is distributed equally throughout the thickening zone.

Figure 4:
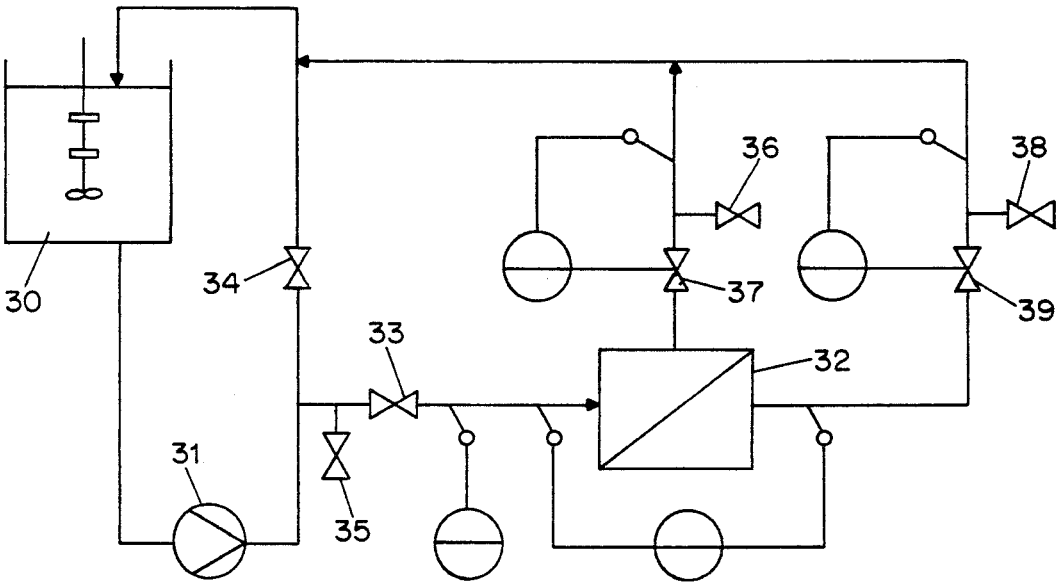
FIG. 4 schematically depicts an arrangement of test equipment used in testing a method and apparatus in accordance with the invention.

The method and apparatus of the invention have been tested in the laboratory in accordance with and utilizing the testing arrangement schematically shown in FIG. 4. Reference numeral 30 denotes a circulation tower from which pulp is pumped by a feed pump 31 to the test, i.e. filter, apparatus 32 through a feed valve. The pulp may, if required, be fed directly back to the circulation tower 30 past the filter apparatus 32 through a valve 34. A sample of unthickened pulp was taken from the extracting member 35 and a sample of thickened pulp from the member 38 downstream of filter valve 39. The desired pressure condition in the filter apparatus 32 may be adjusted by way of the valves 37 and 39. The dimensions of the filter apparatus utilized in the test were:

| | |
|---|---|
| Surface area if the filter cylinder in the testing apparatus | 0.4 $m^2$ |
| Size of perforations in the filter cylinder of the testing apparatus | 0.2 mm |

| Results: | pine sulfate | birch sulfate |
|---|---|---|
| inlet consistency in the apparatus | 0.5% | 0.5% |
| consistency of thickened pulp | 1.5% | 1.5% |
| consistency of filtrate | 0.02% | 0.04% |
| capacity to discharge liquid | 4500–5500 $1/m^2/min$ | |
| pressure difference in the test run | 20–40 kPa | |

Pulsating members of the rotor in the testing apparatus were as shown in FIG. 3

The tests performed demonstrate that it is possible to attain multiplied efficiency with the pressurized thickening method and apparatus of the invention compared with conventional thickeners. The apparatus is, moreover, unusually compact in construction. Due to the pressurized operational principle both the filtrate and the thickened pulp are overpressurized, thereby providing great liberty and the ability to save space in positioning the apparatus to suit mill conditions. Additionally, inflow of air into the pulp in the thickening process is not possible.

When analyzing the filtrate it was found that although its consistency varied between 0.02 and 0.04% it contained very few actual fibers. Rather, the filtrate contained fines, fiber fractions, fillers, extractives and other small impurities. It is thus apparent that the apparatus may be used to separate all kinds of small particles that flow along with the liquid phase. Such particles may be found in great amounts when processing secondary fibers and broke at paper machines. In the processing of mechanical fibers the amount of damaged fibers and small extractives containing fibers is great and one may therefore also expect a greater quantity of particles in the filtrate when dewatering mechanical fibers. This separation of small particles may be used to improve mill operation. For example, by removing extractives and fines before bleaching, a reduction in the consumption of bleaching chemicals will be noted. This reduction is due to the fact that extractives and fines consume a substantial amount bleaching chemicals although bleaching these particles contributes little to overall brightness. Another example of improved mill operation is the removal of small dirt particles from the fiber suspension by permitting the small particles to pass through the filter surface openings and be thereby separated from the suspension. In this manner cleanliness can be improved while thickening the suspension.

Figure 5:
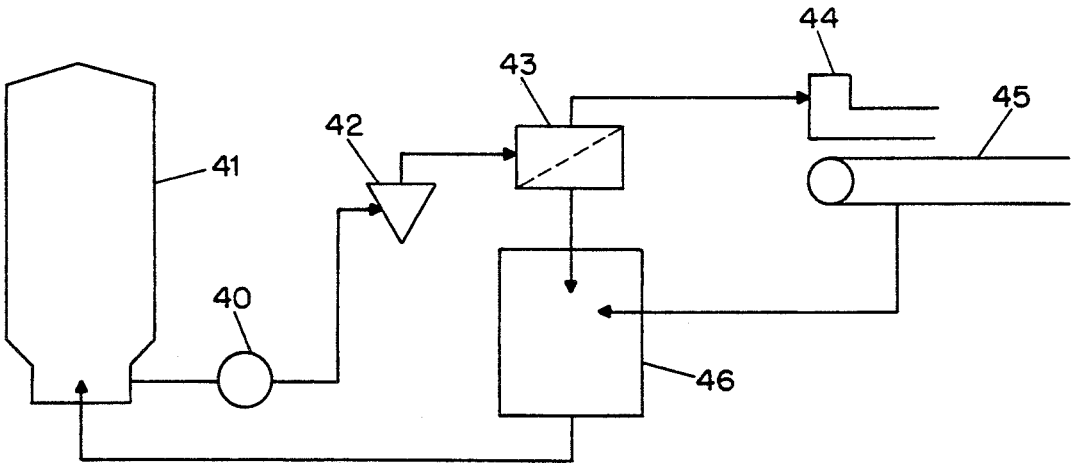
FIGS. 5 and 6 are schematic illustrations of processes utilizing the method and apparatus of the invention.
Figure 6:
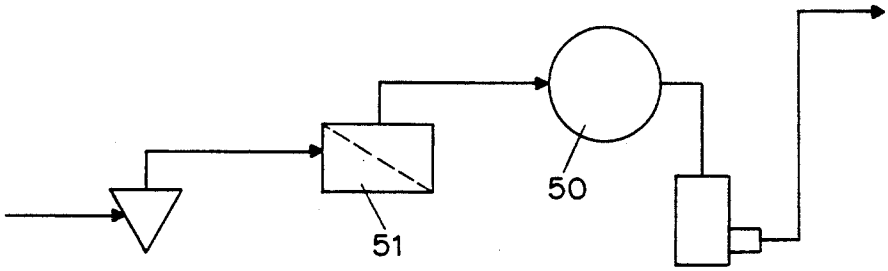
Figure 7:
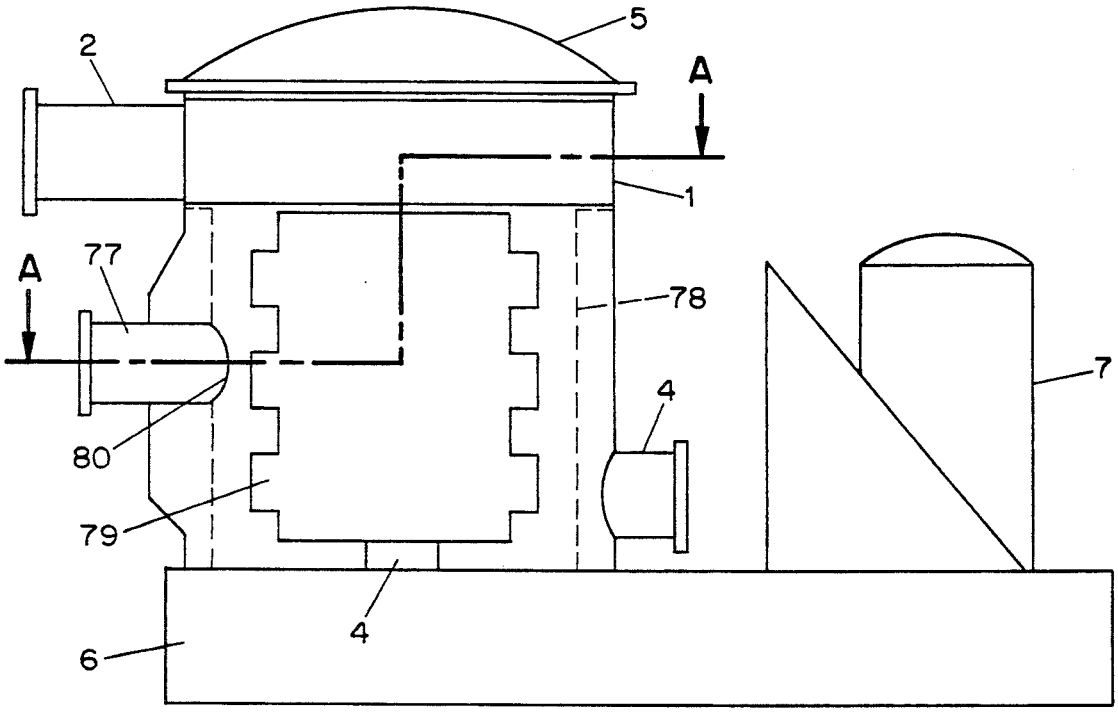
FIGS. 7 and 8 are an elevational and a plan view, respectively, of a third embodiment of an apparatus in accordance with the invention.

The apparatus used in tests conducted in accordance with FIGS. 5 and 6 is, in principle, similar to that of FIG. 7—that is, it comprises a housing 1, a cover 5, a base 6, and drive means 7. The housing has an inlet conduit 2 for the pulp, a discharge conduit 4 for the filtrate and a discharge conduit 77 for the thickened pulp. A discharge conduit for possible reject may be additionally provided in or on the housing. Within the housing is arranged a stationary filter surface 78 and, positionally proximate thereto, a movable surface 79 which may, for example, comprise a rotatable rotor 79 of the type shown in FIG. 3 or of any other suitable type. The embodiment of FIGS. 7 and 8 differs from the earlier herein-disclosed arrangements in that the filter surface is not a uniform cylinder but, rather, has a discharge opening 80 in communication with the discharge conduit 77, the conduit 77 being located not in the lower part of the thickener, as in the apparatus of FIGS. 1 and 2, but on the side of the thickening apparatus.

A variety of advantages are achieved by this arrangement. For example, the opening 80 of the filter surface 78, irrespective of whether it comprises an opening as high as the entire filter surface or lower, generates additional turbulence which cleans the filter surface and the rotor. On the other hand, the thickened pulp does not have to flow between the rotor and the filter surface throughout the entire apparatus down to its lower or bottom part but is, instead, discharged at an earlier stage. It should also be noted that the mutual and relative positions and operation of the filter surface and rotor need not be as described hereinabove; rather, the stationary, not quite uniform cylindrical part may be a member having a surface alternative in accordance with FIG. 3 and the rotational part may be a filter surface, whereby the filtrate is discharged through the rotational member. The illustrated vertically-oriented apparatus may also be arranged horizontally or, if desired, at an inclined or angled orientation.

Figure 8:
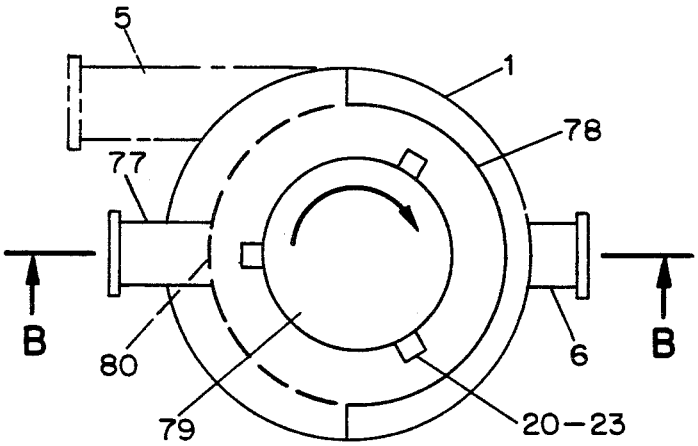
Figure 9:
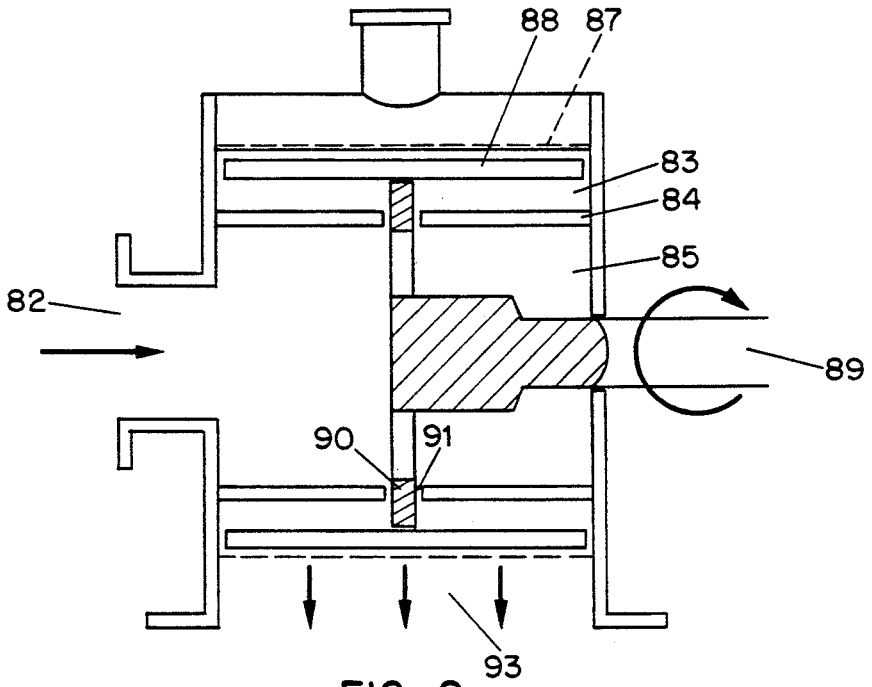
FIGS. 9 and 10 are an elevational and a plan view, respectively, of a fourth embodiment of an apparatus in accordance with the invention.
Figure 10:
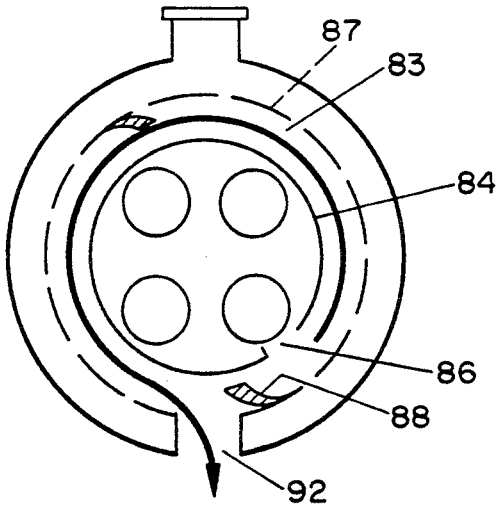

A further development of the embodiment of the apparatus depicted in FIGS. 7 and 8 is shown in FIGS. 9 and 10, in which the pulp is brought axially into the apparatus through a conduit 82. A filtering chamber 83 is separated by a stationary cylinder 84 from the central portion 85 of the apparatus, from which central portion the pulp may flow out through only one substantially axial slot 86 in the cylindrical inner wall 84 into the chamber 83 defined between the cylindrical surface 84 and the filter surface 87. Disposed within the chamber 83 is a rotatable rotor or blade member 88, the purpose of which is to operatively keep the pulp in motion, to mix it and to control the thickness of the fiber mat on the filter surface 87. The rotor or blade member 88 is preferably mounted on a shaft 89 by means of an arm 90 arranged in substantially the central portion of the apparatus and extending through a slot 91 in the cylindrical wall 84. Pulp is discharged from the apparatus shown in FIG. 7 through an opening 92 positioned at the same height as the apparatus on the filter surface 87, through which opening the pulp can flow into the discharge conduit 93. By providing a throttle means in the discharge conduit 93 it is possible to control the total time that the pulp circulates in the apparatus before flowing into the discharge conduit 93. The openings 86, 92 of the cylinder and of the filter surface, respectively, are preferably so located relative to each other that the blade member 88, commencing the circulation of the pulp flowing in from the opening 86 of the cylinder, enters from the direction of the opening 92 of the filter surface, whereby the pulp is caused to circulate about at least almost the entire inner circumference or periphery of the thickener before its first possibility of exiting the apparatus through the discharge conduit 93.

One advantage of the apparatus of FIGS. 7, 8, 9 and 10, as compared to the arrangements shown in FIGS. 1 and 2 and in accordance with the results of tests, is that the operation of the former is relatively easy to adjust. The pressure above the filter surface remains the same along the height or length of the filter surface and does not, as in some prior art arrangements, vary.

Figure 11:
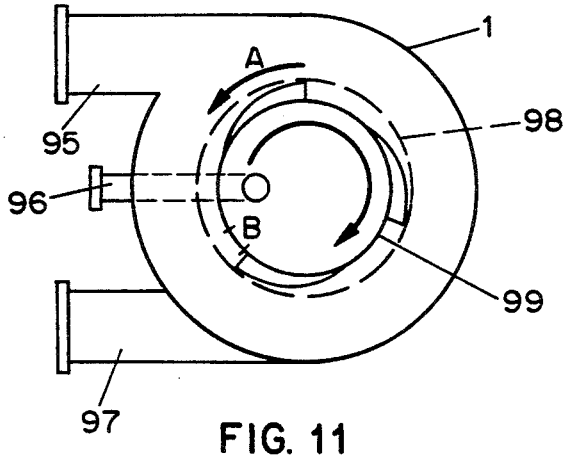
FIG. 11 is a plan view of a fifth embodiment of an apparatus in accordance with the invention.

The further modified apparatus shown in FIG. 11 is quite similar to that depicted in FIG. 1. The apparatus is seen as viewed from above and comprises a housing 1, conduits 95, 96 and 97 for the intake of pulp to be dewatered, for the discharge of filtrate and for the discharge of thickened pulp, respectively, a filter surface 98, and a rotor 99 provided interiorly of the filter surface. The pulp is fed into the chamber outwardly of the filter surface 98—i.e. between the housing 1 and the filter surface 98—whereby discharge of the filtrate is effected in the direction opposite to that of the other embodiments; in other words, the filtrate flows inwardly through the filter surface 98. In this embodiment it is sometimes advantageous to make the filter surface rotatable and the surface inside it stationary, whereby the stationary surface subjects the filter surface to pulses for removing filtrate through the filter surface and for loosening or removing the fiber mat.

In one preferred embodiment the stationary surface includes recesses which are effective to generate suction through the filter surface. These recesses may be open—i.e. have their open ends—toward or at that part ascending to the same level as the rest of the surface so as to generate a pulse directed opposite to the filter surface for loosening the fiber mat formed on the filter surface, or the recesses may be open toward the opening through which the liquid filtered through the filter surface is directed to the inside of the surface and further led for discharge from the apparatus. The advantages of an apparatus constructed in accordance with this embodiment include, first, the ability to create an intensive suction effect on the inside surface of the filter surface, whereby the thickening effect is rendered unusually efficient. Second, when operating as a rotor the surface need not cause the entire pulp flow entering the apparatus to undergo rotational movement, so that a savings in energy consumption is achieved. Third, energy is also saved by predeterminately configuring or shaping the surface 98 so as to minimize the amount of energy consumed, irrespective of whether the surface operates as a rotor or as a stationary, pulse generating surface. This is a particular object, for example, for the last-described embodiment in which recesses are provided on the stationary surface. In this embodiment the pulse members may, in fact differ somewhat from that shown in FIG. 3 because their most important function is to subject the filter surface to a long suction that is as even as possible and as a result of which filtrate is removed, through the filter surface, from the pulp. As should be apparent, the intensity of the suction effect determines the length of the suction stage. If the suction is very intensive, the pulp tends to thicken quickly on the filter surface whereby the length of the suction pulse may not be so great that the pressure pulse is no longer able to loosen the fiber mat on the filter surface. By adjusting the speed difference between the filter surface and the surface generating pulses, on the other hand, the desired thickening speed may be varied so as to optimize the relation of the filtrate discharge to the amount of fiber mat.

Figure 12:
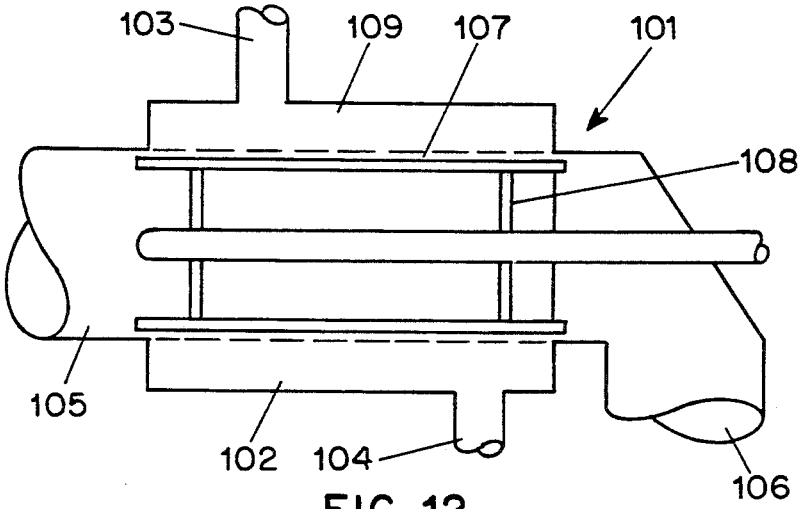
FIG. 12 is an elevational view of a sixth embodiment of an apparatus in accordance with the invention.

A sixth embodiment of a thickening apparatus in accordance with the invention is shown in FIG. 12; this last embodiment is quite different from those hereinabove shown and described. The apparatus 101 of FIG. 12 is intended for most advantageous use in a horizontal position. It comprises a cylindrical housing 102 having two conduits 103 and 104 for the gas and for the filtrate, respectively. The inlet conduit 105 for pulp to be thickened is located at one end of the apparatus and a discharge conduit 106 for the dewatered pulp is provided at the opposite end of the apparatus. In one form or version of this embodiment a filtering drum 107 disposed axially within the housing 102 is stationary and a rotor 108 located inside the drum and for maintaining the motion in the pulp is operatively rotatable. Air or other gas is fed from behind the filter surface 107, through the conduit 103, and into a chamber 109 that surrounds the filtering drum. The air may be fed either as a pulsating or continuous flow and, most importantly, the air replaces the water which is radially removed from pulp layer and discharged from the apparatus through the conduit 104. The thickened pulp is directed out of the apparatus from the opposite end with respect to the feed end at the same pressure as the infed pulp. The pressure difference prevailing between the filtrate and the infed pulp is 20–100 kPa, depending on the particular case.

In another version of this embodiment the thickening drum rotates and compressed air is blown or directed onto any sector or sectors of the drum. The air stream may be continuous so as to ensure that the filter surface remains clean.

The flow of air into the thickener may in some cases be utilized so that an air bubble is permitted to grow at the center of the thickening apparatus whereby the air bubble is effective to control the thickness of the fibrous layer moving close to the filtering surface. In this arrangement the rotor generates a sufficient shear force field in the pulp layer to mix the pulp and to successfully effect thickening. When required—as where a pressurized thickener is involved—the air bubble may be replaced by a central member between which member and the filter surface the rotor operatively rotates. It should be noted that when utilizing a gas bubble interiorly of the filtering surface the rotor may be formed of several foil-type blades, since the gas bubble controls the thickness of the pulp layer to be thickened and the blades only mix the pulp and control the thickness of the pulp mat on the filter surface.

A feature that is essential or important to each of the above-described arrangements is that a relatively thin pulp layer is somehow arranged or disposed or maintained close to the filter surface. At the same time, each arrangement is effective to insure that the entire volume of pulp which flows into the apparatus comes into contact with the filter surface, thereby enabling small particles to be separated, and that a substantially uniform consistency of the pulp inside the filtering chamber is maintained without regard to distance from the filter surface.

Test runs have shown that the higher the pulp consistency, the larger the filter plate opening that may be used. This occurs because the fiber network is at that moment stronger and a single fiber is not loosened from it with any reasonable degree of ease. As a consequence, filter plates having openings of one or more sizes may be employed. It is known that a larger opening provides greater penetration and, in addition, the apparatus is less costly to manufacture. The most practical arrangement is one in which, for example, the perforations are smallest at their inlet ends, are slightly larger in the middle and are largest at their thickened pulp discharge ends.

Figure 13A:
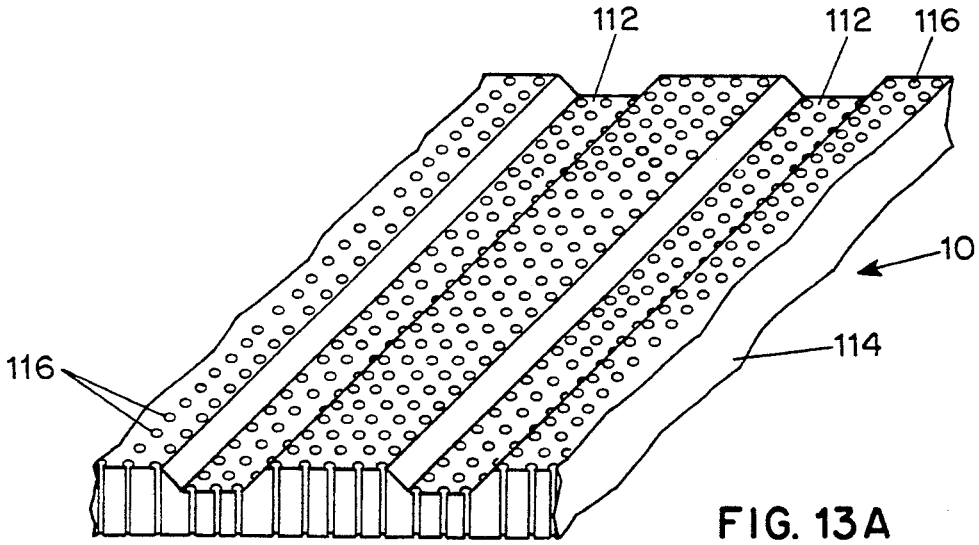
FIGS. 13 (13A, 13B and 13C) and 14 (14A and 14B) depict first and second embodiments, respectively, of filter plates effective for increasing turbulence at the filter plate surface so as to improve the separation of fine particles.
Figure 13B:
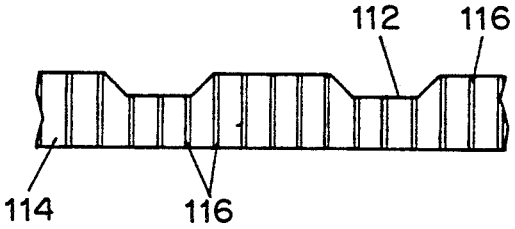
Figure 13C:
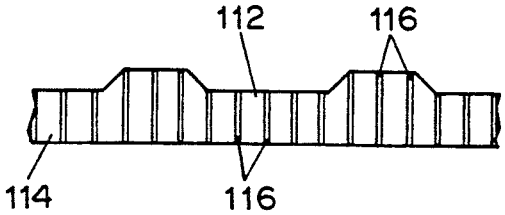
Figure 14A:
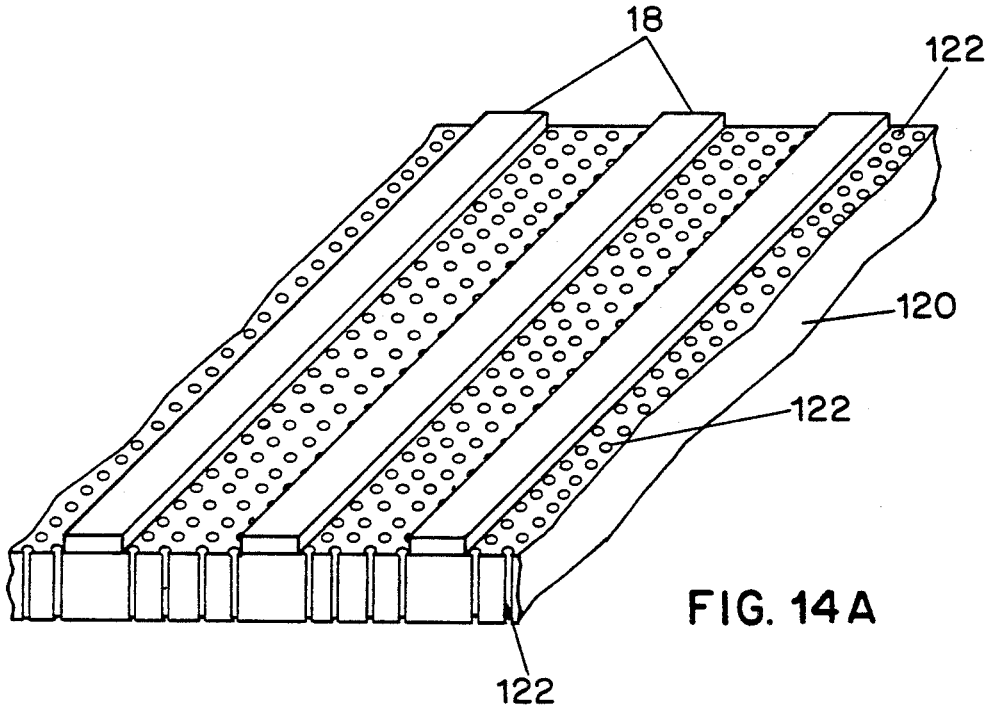
Figure 14B:
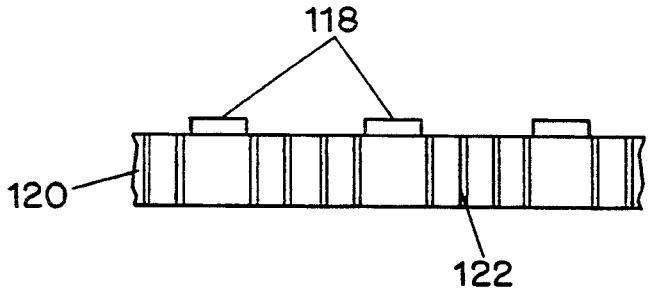

FIGS. 13A, 13B and 13C, on the one hand, and FIGS. 14A and 14B, on the other, depict filter plates having uneven surfaces. In FIGS. 13A, 13B and 13C, the filter plate 110 is formed by machining or otherwise forming grooves 112 in the surface of a smooth plate 114. The openings—in the form of small holes 116 or slots or the like—may be machined or formed in the plate 114 either before or after the grooving. The filter plate illustrated in FIGS. 14A, 14B is fabricated by attaching ridges or bars 118 on a smooth plate 120. In the form of the plate there shown, the openings 122 have been machined or otherwise formed in the plate prior to attachment of the bars 118 thereto. The openings may alternatively, of course, be defined in the plate after attachment of the bars 118 in which case they will also extend through the bars. The uneven surface of the filter plate—for both the FIG. 13 and FIG. 14 embodiments—is disposed so as to face the fiber suspension to be dewatered. In this manner, additional turbulence is created in the fiber suspension flowing over the filtering surface. This additional turbulence provides certain advantages with respect to the removal of fines. For example, the additional turbulence breaks up fiber agglomerates at the surface of the filter plate and enables the fine particles to reach the filter plate more easily and thereby be separated. The additional turbulence also loosens, from the fiber, dirt particles attached thereto and thereby facilitates the separation of such particles together with the filtrate.

As should by now be apparent from the foregoing description, a new type of pulp thickening method and apparatus has been developed, by virtue of which it is possible to minimize or eliminate the drawbacks and deficiencies of prior art apparatus and techniques without creating new or additional problems. Although only a relatively few advantageous apparatus alternatives and points of application have been expressly described in this disclosure, they are by no means intended to restrict the scope of the invention from that which is defined in the appended claims. Thus, by way of example, both the filter surface and the surface movable relative to the filter surface may be of a form other than cylindrical, these members being characterized only in that they are substantially rotationally symmetrical—be it cylindrical, conical, spherical, a combination thereof, or otherwise shaped or constructed for that purpose.

What is claimed is:

1. In a method of thickening a fiber suspension and separating fine particles therefrom, wherein the fiber suspension is introduced into a filtering apparatus provided with at least one filtering surface having a plurality of apertures, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface;

forming a fiber mat on the filtering surface by predeterminately sizing the filter surface apertures for retaining fibers of the fiber suspension on the filtering surface to define the fiber mat; and continuously controlling the thickness of the fiber mat that forms on the filtering surface by subjecting the fiber mat to shear stresses.

2. In a method in accordance with claim 1 wherein said controlling of the thickness of the fiber mat prevents the uncontrolled formation of said fiber mat on the filter surface, said removing of liquid from the suspension to be thickened comprising subjecting the filtering surface to alternating positive (pressure) and negative (suction) pulses so as to loosen fibers stuck in openings of the filtering surface and thereby permit the filtrate to flow through said filtering surface openings.

3. In a method in accordance with claim 1, wherein the fiber suspension is thickened from a consistency of 0.3–1.0% to a consistency of 1.0–5.0%.

4. In a method in accordance with claim 1, wherein the fiber suspension is thickened from a consistency of 3–10% to a consistency of 10–25%.

5. In a method of thickening a fiber suspension and separating fine particles therefrom, wherein the fiber suspension is introduced into a filtering apparatus provided with at least one filtering surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, said step of forming the suspension to be thickened into a layer comprising operationally dividing said layer into a mixing zone located outwardly of the filtering surface and a thickening zone located inwardly of the filtering surface, said step of continuously mixing the layer comprising continuously mixing fiber suspension in the mixing zone to equalize differences in suspension consistency, and said step of controlling the fiber mat thickness comprising subjecting fiber suspension in the thickening zone to sheer forces generated by both friction between said mixing and thickening zones and the movement of a mixing member, whereby liquid is removed from the thickening zone.

6. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

forming a fiber mat, from said layer of pulp, on the filtering surface by predeterminately sizing the filter surface apertures for retaining fibers of the fiber suspension on the filtering surface to define the fiber mat;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and continuously regulating a pressure difference across the at least one filtering surface so as to prevent uncontrolled formation of said fiber mat on said filtering surface and to control the thickness of said fiber mat.

7. In a method in accordance with claim 6, wherein the fiber suspension is thickened from a consistency of 0.3–1.0% to a consistency of 1.0–5.0%.

8. In a method in accordance with claim 6, wherein the fiber suspension is thickened from a consistency of 3–10% to a consistency of 10–25%.

9. In a method of thickening a fiber suspension and separating fine particles therefrom, wherein the fiber suspension is introduced into a filtering apparatus provided with at least one filtering surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, wherein the suspension to be thickened is introduced into the filtering chamber along substantially the full axial length of the chamber, the suspension to be thickened is caused to rotate in the chamber, liquid is removed from the suspension to be thickened and the thickened suspension is discharged from the filtering chamber along substantially the full length of said chamber, and the consistency of the suspension is maintained substantially uniform throughout the filtering chamber.

10. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and regulating a pressure difference across the at least one filtering surface so as to prevent uncontrolled formation of a fiber mat on said filtering surface and to control the thickness of said fiber mat, wherein the suspension to be thickened is introduced into the filtering chamber along substantially the full axial length of the chamber, the suspension to be thickened is fed into a filtering chamber, the suspension to be thickened is caused to rotate in the chamber, liquid is removed from the suspension to be thickened and the thickened suspension is discharged from the filtering chamber along substantially the full length of said chamber, and the consistency of the suspension is maintained substantially uniform throughout the filtering chamber.

11. In a method of thickening a fiber suspension and separating fine particles therefrom, wherein the fiber suspension is introduced into a filtering apparatus provided with at least one filtering surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, wherein the specific energy used for thickening the suspension is in the range of 15 to 50% of the energy required for complete fluidization of said suspension.

12. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and regulating a pressure difference across the at least one filtering surface so as to prevent uncontrolled formation of a fiber mat on said filtering surface and to control the thickness of said fiber mat, wherein the specific energy used for thickening the suspension is in the range of 15 to 50% of the energy required for complete fluidization of said suspension.

13. In a method of thickening a fiber suspension and separating fine particles therefrom, wherein the fiber suspension is introduced into a filtering apparatus provided with at least one filtering surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, wherein the specific energy used in mixing the suspension in the thickening zone is in the range of 3 to 15% of the energy required for complete fluidization of said suspension.

14. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and regulating a pressure difference across the at least one filtering surface so as to prevent uncontrolled formation of a fiber mat on said filtering surface and to control the thickness of said fiber mat, wherein the specific energy used for mixing the suspension in the thickening zone is in the range of 3 to 15% of the energy required for complete fluidization of said suspension.

15. In a method of thickening a fiber suspension and separating fine particles therefrom, wherein the fiber suspension is introduced into a filtering apparatus provided with at least one filter surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, wherein the specific energy used for controlling the thickness of the fiber mat on the filtering surface is in the range of 50 to 80% of the energy required for complete fluidization of said suspension.

16. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and regulating a pressure difference across the at least one filtering surface so as to prevent uncontrolled formation of a fiber mat on said filtering surface and to control the thickness of said fiber mat, wherein the specific energy used for controlling the thickness of the fiber mat on the filtering surface is in the range of 50 to 80% of the energy required for complete fluidization of said suspension.

17. In a method of thickening a fiber suspension and separating fine particles therefrom, wherein the fiber suspension is introduced into a filtering apparatus provided with at least one filtering surface, the suspension is caused to move in relation to said at least one filtering surface and is thickened by removing liquid from the suspension through said filtering surface, and the thickened suspension and the liquid passed through the filtering surface are separately discharged from the apparatus, the improvement comprising:

feeding the fiber suspension to be thickened into a filtering chamber;

forming the suspension to be thickened into a layer in said filtering chamber and continuously mixing the layer of suspension so as to equalize differences in consistency;

continuously removing liquid from the suspension to be thickened by passing the liquid and fine particles carried by the liquid through the filtering surface and out of the filtering chamber, said thickened suspension remaining within the filtering chamber for discharge from the filtering apparatus, so as to remove from the fiber suspension the fine particles that pass through the filtering surface; and controlling the thickness of a fiber mat that forms on the filtering surface by subjecting the fiber mat to shear stresses, wherein said layer of suspension is formed interiorly of the filtering surface by locating a gas bubble centrally within the apparatus so as to force the suspension to flow along the filtering surface.

18. In a method of thickening a fiber suspension and separating fine particles therefrom, wherein fiber suspension to be thickened is introduced into a filtering apparatus provided with at least one filtering surface, the suspension to be thickened is fed into a filtering chamber, the suspension to be thickened is caused to execute a rotational movement with respect to the at least one filtering surface and is thickened by removing liquid from the suspension through said filtering surface, and the thickened suspension and the liquid passed through the filtering surface are separately discharged from the apparatus, the improvement comprising:

introducing the suspension to be thickened into the thickening apparatus in a pressurized state;

bringing a substantially thin layer of pulp to be thickened into communication with the filtering surface;

continuous mixing said thin layer of pulp so as to maintain a substantially constant consistency of the suspension throughout the layer, and removing liquid from the suspension by passing the liquid and fine particles carried by the liquid through the filtering surface and out of the filtering chamber, said thickened suspension remaining within the filtering chamber for discharge from the filtering apparatus so as to remove from the fiber suspension the fine particles that pass through the filtering surface; and regulating a pressure difference across the at least one filtering surface so as to prevent uncontrolled formation of a fiber mat on said filtering surface and to control the thickness of said fiber mat, wherein said layer of suspension is formed interiorly of the filtering surface by locating a gas bubble centrally within the apparatus so as to force the suspension to flow along the filtering surface.

19. An apparatus for thickening a fiber suspension and separating fine particles therefrom, comprising:

a housing (1, 102);

a cover (5);

an inlet conduit for suspension to be thickened (2, 82, 95, 105);

a discharge conduit for thickened suspension (3, 77, 93, 106);

at least one stationary member in said housing;

a rotary member in said housing;

one of said stationary member and said rotary member defining a filtering surface, said filtering surface having an opening (80, 92) through which the thickened suspension is directed to said discharge conduit for discharge from the thickening apparatus;

drive means (7) for operatively effecting rotation of said rotary member;

means (12) on at least one of said stationary member and said rotary member for non-mechanically limiting the thickness of a fiber mat formable on the filtering surface so as to prevent the uncontrolled formation of the fiber mat, and permit the removal of liquid from the suspension by passing the liquid and fine particles carried by the liquids through the filtering surface and discharging said liquid and fine particles out from said apparatus, wherein said opening (92) has a length and said filtering surface (87) has an axial length, said opening length being substantially equal to said filtering surface axial length.

20. An apparatus for thickening a fiber suspension and separating fine particles therefrom, comprising:

a housing (1, 102);

a cover (5);

an inlet conduit for suspension to be thickened (2, 82, 95, 105);

a discharge conduit for thickened suspension (3, 77, 93, 106);

at least one stationary member in said housing;

a rotary member in said housing;

one of said stationary member and said rotary member defining a filtering surface;

drive means (7) for operatively effecting rotation of said rotary member;

means (12) on at least one of said stationary member and said rotary member for non-mechanically limiting the thickness of a fiber mat formable on the filtering surface so as to prevent the uncontrolled formation of the fiber mat, and permit the removal of liquid from the suspension by passing the liquid and fine particles carried by the liquids through the filtering surface and discharging said liquid and fine particles out from said apparatus; a substantially cylindrical member (84) disposed within said apparatus housing and having a substantially axial slot (86) through which suspension to be thickened is flowable between said cylindrical member (84) and said filtering surface (87).

21. An apparatus for thickening a fiber suspension and separating fine particles therefrom, comprising:

a housing (1, 102);

a cover (5);

an inlet conduit for suspension to be thickened (2, 82, 95,105);

a discharge conduit for thickened suspension (3, 77, 93, 106);

at least one stationary member in said housing;

a rotary member in said housing;

one of said stationary member and said rotary member defining a filtering surface;

drive means (7) for operatively effecting rotation of said rotary member;

means (12) on at least one of said stationary member and said rotary member for non-mechanically limiting the thickness of a fiber mat formable on the filtering surface so as to prevent the uncontrolled formation of the fiber mat, and permit the removal of liquid from the suspension by passing the liquid and fine particles carried by the liquids through the filtering surface and discharging said liquid and fine particles out from said apparatus; a substantially cylindrical member (84) disposed within said apparatus housing and having a substantially axial slot (86) through which suspension to be thickened is flowable between said cylindrical member (84) and said filtering surface 987), wherein said rotary member (88) is disposed in a space defined between said cylindrical member (84) and said filtering surface (87).

* * * * *